US010240880B1

(12) United States Patent
Viani

(10) Patent No.: US 10,240,880 B1
(45) Date of Patent: Mar. 26, 2019

(54) FIREARM ENHANCING TRIGGER CONNECTOR

(71) Applicant: Arthur J. Viani, Miami, FL (US)

(72) Inventor: Arthur J. Viani, Miami, FL (US)

( * ) Notice: Subject to any disclaimer, the term of this patent is extended or adjusted under 35 U.S.C. 154(b) by 0 days.

(21) Appl. No.: 15/918,488

(22) Filed: Mar. 12, 2018

(51) Int. Cl.
*F41A 19/32* (2006.01)

(52) U.S. Cl.
CPC ..... *F41A 19/32* (2013.01)

(58) Field of Classification Search
CPC ..... F41A 19/10; F41A 7/72
USPC ..... 42/69.01, 69.03
See application file for complete search history.

(56) References Cited

U.S. PATENT DOCUMENTS 5,822,903 A 10/1998 Davis
6,354,032 B1 * 3/2002 Viani ..... F41A 19/10 42/42.03
7,500,327 B2 * 3/2009 Bubits ..... F41A 17/72 42/69.02
9,062,925 B1 * 6/2015 Viani ..... F41A 19/06
9,404,700 B1 * 8/2016 Viani ..... F41A 19/06
9,410,758 B1 8/2016 Viani
9,927,200 B2 * 3/2018 Kuracina ..... F41A 19/30
2005/0034344 A1 * 2/2005 Viani ..... F41A 19/12 42/69.01
2006/0236581 A1 * 10/2006 Viani ..... F41A 19/30 42/69.01

* cited by examiner

*Primary Examiner* — Michelle Clement
(74) *Attorney, Agent, or Firm* — Albert Bordas, P.A.

(57) ABSTRACT

A firearm enhancing trigger connector having a torso with first and second edges. The torso has a guide lip mount extending from the torso beyond the first edge at a first predetermined angle. The guide lip mount has a guide lip positioned at a predetermined angle approximately 65-75 degrees with respect to the second edge. The torso further has a first connector leg extending from the torso towards the first edge. The first connector leg has a reset tab. The torso also has a second connector leg that removably fits within a trigger housing of the firearm. A trigger bar nearly contacts or contacts the guide lip when the firearm is in a rest position.

17 Claims, 5 Drawing Sheets

FIREARM ENHANCING TRIGGER CONNECTOR

BACKGROUND OF THE INVENTION

1. Field of the Invention

The present invention relates to firearm trigger connectors, and more particularly, to firearm enhancing trigger connectors.

2. Description of the Related Art

Applicant believes that one of the closest references corresponds to Applicant's own U.S. Pat. No. 9,062,925 issued to Arthur Viani on Jun. 23, 2015 for Enhanced trigger control connector. However, it differs from the present invention because Viani teaches a firearm enhanced trigger control connector. A torso has a guide angle positioned at a first predetermined angle. The guide angle contains a trigger bar of a firearm. The torso further has a first connector leg extending therefrom at a second predetermined angle. The first connector leg has a disconnector tab at a third predetermined angle. Extending from the first connector leg is a control tab. The torso further has a second connector leg that removably fits within a trigger housing of the firearm.

Applicant believes that another reference corresponds to Applicant's own U.S. Pat. No. 9,410,758 issued to Arthur Viani on Aug. 9, 2016 for Enhanced trigger control connector. However, it differs from the present invention because Viani teaches a firearm enhanced trigger control connector. A torso has a guide angle positioned at a first predetermined angle. The guide angle contains a trigger bar of a firearm. The torso further has a first connector leg extending therefrom at a second predetermined angle. The first connector leg has a disconnector tab at a third predetermined angle. Extending from the first connector leg is a control tab. The torso further has a second connector leg that removably fits within a trigger housing of the firearm.

Applicant believes that another reference corresponds to Applicant's own U.S. Pat. No. 9,404,700 issued to Arthur Viani on Aug. 2, 2016 for Enhanced trigger control connector. However, it differs from the present invention because Viani teaches a firearm enhanced trigger control connector. A torso has a guide angle positioned at a first predetermined angle. The guide angle contains a trigger bar of a firearm. The torso further has a first connector leg extending therefrom at a second predetermined angle. The first connector leg has a disconnector tab at a third predetermined angle. Extending from the first connector leg is a control tab. The torso further has a second connector leg that removably fits within a trigger housing of the firearm.

Applicant believes that another reference corresponds to U.S. Pat. No. 5,822,903 issued to Sr. James Jefrey Davis, on Oct. 20, 1998 for Externally adjustable slide trigger assemblies for handguns. However, it differs from the present invention because Davis teaches an externally adjustable slide trigger assembly, which is a drop-in replacement for existing conventional slide triggers. No drilling/tapping or other handgun modifications are required. The variable adjustment range provided allows the handgun owner to change trigger-pull characteristics from a stock trigger-pull weight to a low competition trigger-pull weight in the field. Trigger slack is completely eliminated at or near competition trigger-pull weights.

Applicant believes that another reference corresponds to U.S. Patent Application Publication No. 20060236581 published on Oct. 26, 2006 to Applicant's own Arthur Viani for Self-cleaning trigger connector system. However, it differs from the present invention because Viani teaches a self-cleaning trigger connector system resulting in increased reliability comprising a self-cleaning trigger connector and a trigger mechanism housing. The self-cleaning trigger connector is designed with specific contact points to prevent over-travel of the trigger bar when operating in cooperation with the trigger of the firearm. The self-cleaning trigger connector has a first at least one elongated through hole of a predetermined length that allows for a lighter trigger pull and defines a lubrication reservoir. The trigger mechanism housing comprises a second at least one elongated through hole. Debris that accumulates from the interaction between the trigger bar and the self-cleaning trigger connector passes through the first and second at least one elongated through holes. After passing through the first and second at least one elongated through holes, the debris then falls downwardly through a cavity adjacent to the firearm magazine well.

Other patents describing the closest subject matter provide for a number of more or less complicated features that fail to solve the problem in an efficient and economical way. None of these patents suggest the novel features of the present invention.

SUMMARY OF THE INVENTION

The present invention is a firearm enhancing trigger connector, comprising a torso having first and second edges. The torso has a guide lip mount extending from the torso beyond the first edge at a first predetermined angle. The guide lip mount comprises a guide lip positioned at a second predetermined angle approximately 65-75 degrees with respect to the second edge. The guide lip contains a trigger bar of a firearm. The torso further comprises a first connector leg extending from the torso towards the first edge at a third predetermined angle. The first connector leg has a reset tab at a fourth predetermined angle approximately between 81 degrees and 91 degrees with respect to the first connector leg. The torso further comprises a second connector leg that removably fits within a trigger housing of the firearm. The trigger bar nearly contacts or contacts the guide lip when the firearm is in a rest position.

The guide lip mount extends from the torso beyond the first edge a first predetermined distance and the first connector leg extends from the torso beyond the first edge a second predetermined distance. The first predetermined distance is greater than the second predetermined distance. The first connector leg extends from the second edge. The reset tab is positioned over the guide lip and the guide lip is shorter in length than the reset tab.

The guide lip contains the trigger bar of the firearm when biased against the guide lip. The trigger bar is biased against the torso when the firearm is in the rest position. The nearly contacts is a distance up to approximately 3 mm. As a trigger is pulled, the trigger bar slidably travels generally in a rearward and downward direction and the guide lip serves to guide an end of the trigger bar with no obstruction. The no obstruction is achieved with the second predetermined angle for the guide lip, saving a user from exerting a second force after exerting an initial force to pull the trigger. After a point of firing, the trigger bar continues to travel generally in a rearward and downward direction. A lobe cams the reset tab while cycling until completing an operating cycle with minimal obstruction. The minimal obstruction is achieved with the fourth predetermined angle of the reset tab, minimizing torsion forces while the cycling occurs. The second connector leg is approximately opposite in direction from the guide lip and the reset tab. The second predetermined angle is approximately 70 degrees and the fourth predetermined angle is approximately 86 degrees.

It is therefore one of the main objects of the present invention to provide a firearm enhancing trigger connector utilized to correct a trigger bar obstruction.

It is another object of the present invention to provide a firearm enhancing trigger connector for firearms to minimize trigger bar obstruction while it is traveling generally in a rearward and downward direction as the trigger is pulled, defining an undesired trigger pull effort.

It is another object of the present invention to provide a firearm enhancing trigger connector to prevent over manipulation of the trigger, which causes a reduction of accuracy while repetitive firing.

It is another object of the present invention to provide a firearm enhancing trigger connector to increase the speed of firing a firearm with a reduced trigger travel distance.

It is another object of the present invention to provide a firearm enhancing trigger connector utilized with semi-automatic pistols that have an enclosed striker assembly.

It is yet another object of this invention to provide such a firearm enhancing trigger connector that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1A:
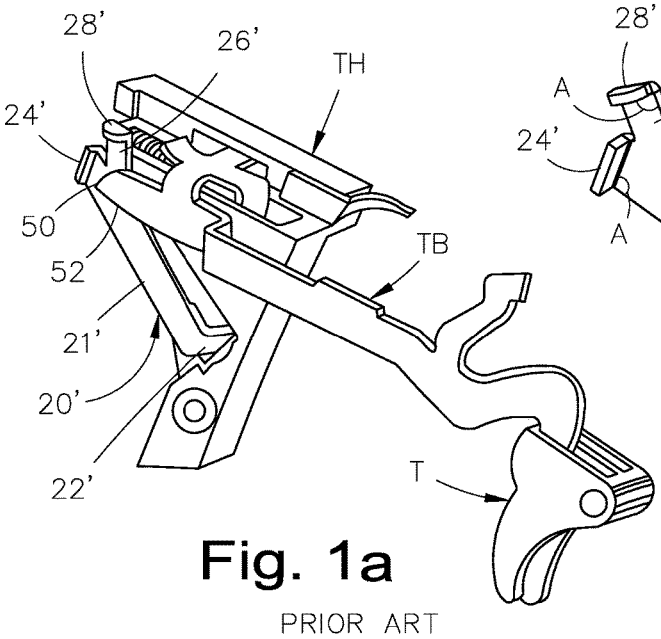
Fig. 1a PRIOR ART
FIG. 1*a* is an isometric view of the prior art trigger connector mounted onto a trigger bar and housing.

Referring now to the drawings, the present invention is generally referred to with numeral 10. It can be observed that it basically includes firearm enhancing trigger connector 220, bent at predetermined locations to permit its mechanical transactions to effectuate a trigger connector mechanism for minimizing trigger pull effort and torsion force effects.

Figure 1:
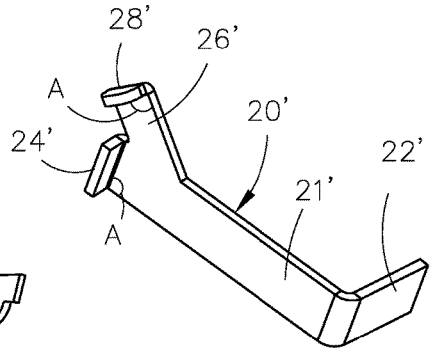
Fig. 1 PRIOR ART
FIG. 1 is an isometric view of a prior art trigger connector.

Seen in FIGS. 1 and 1*a* is prior art connector 20'. Torso 21' has lip 24'. Lip 24' serves to contain trigger bar TB when biased against it. Lip 24' is at angle A. Angle A is approximately 90 degrees. Connector leg 26' extends from torso 21' at a predetermined angle and has connector lip 28'. Connector lip 28' is at angle A from connector leg 26'. Angle A is approximately 90 degrees. Opposite in direction from lip 24' and connector lip 28' is connector leg 22'. FIG. 1*a* illustrates trigger bar TB secured onto trigger housing TH. Connector leg 22' removably fits within firearm F, seen in FIG. 2, to remain secured.

Figure 2:
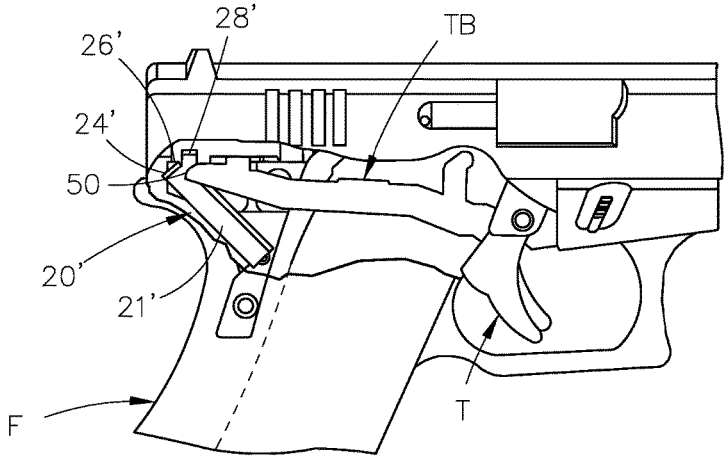
Fig. 2 PRIOR ART
FIG. 2 is an elevation view of the prior art trigger connector mounted onto the trigger bar and housing, before firing a firearm.

As seen in FIG. 2, prior art connector 20' works in conjunction with trigger bar TB. While firearm F, is in the rest position, trigger bar TB is biased against torso 21'. As trigger T is pulled, trigger bar TB slidably travels generally in a rearward and downward direction establishing undesired trigger pull excess travel.

Figure 2A:
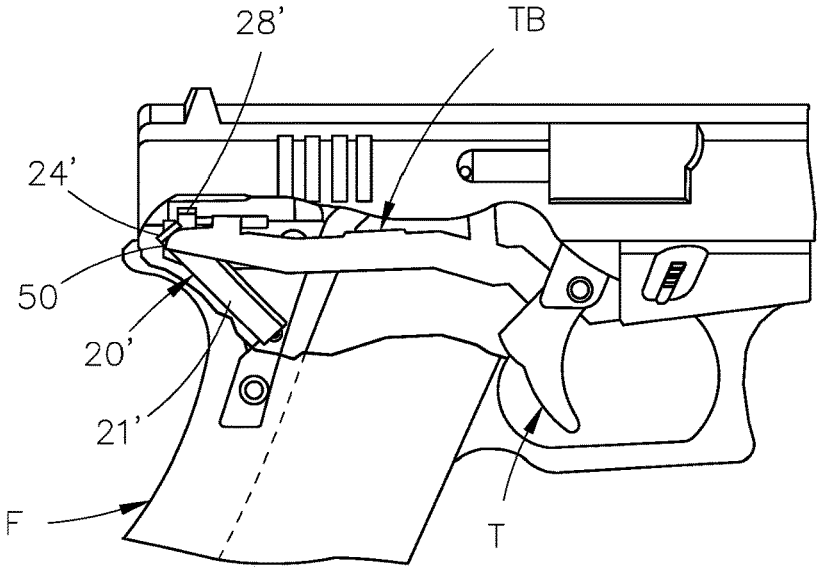
Fig. 2a PRIOR ART
FIG. 2*a* is an elevation view of the prior art trigger connector seen in FIG. 2, at the point of firing the firearm.

As seen in FIG. 2*a*, lip 24' serves to guide end 50. However, due to its position and angle A, lip 24' also is an obstruction. This obstruction causes a user to exert a second force to overcome the obstruction after exerting an initial force to pull trigger T. Thus, resulting in a reduction of accuracy and precision when firing. Trigger bar TB remains biased against torso 21' at the point of firing.

Figure 2B:
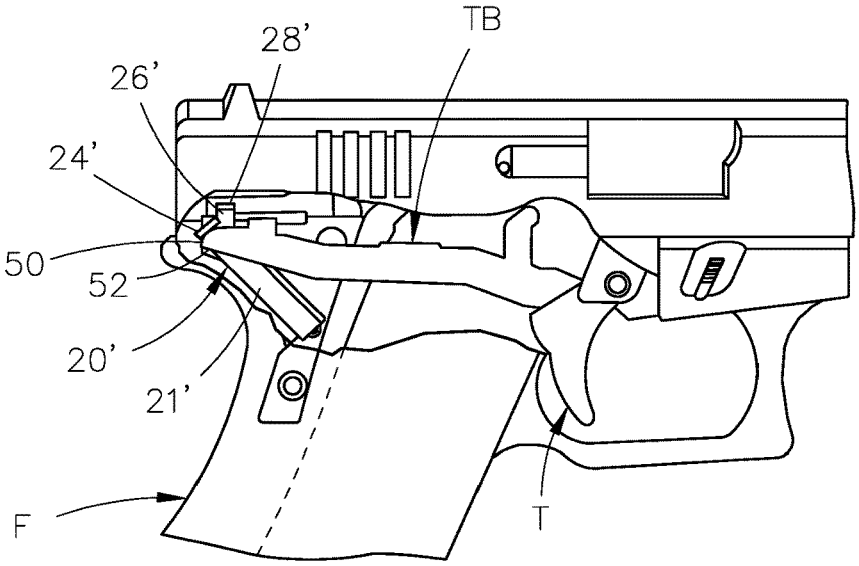
Fig. 2b PRIOR ART
FIG. 2*b* is an elevation view of the prior art trigger connector seen in FIG. 2*a*, after firing the firearm.

As seen in FIG. 2*b*, after the point of firing, trigger bar TB continuous to travel generally in a rearward and downward direction until a spring force, not shown, causes trigger bar TB to shift. Guided by connector lip 28', edge 52 of trigger bar TB slidably travels generally in a forward and upward direction until completing the operating cycle.

Figure 3:
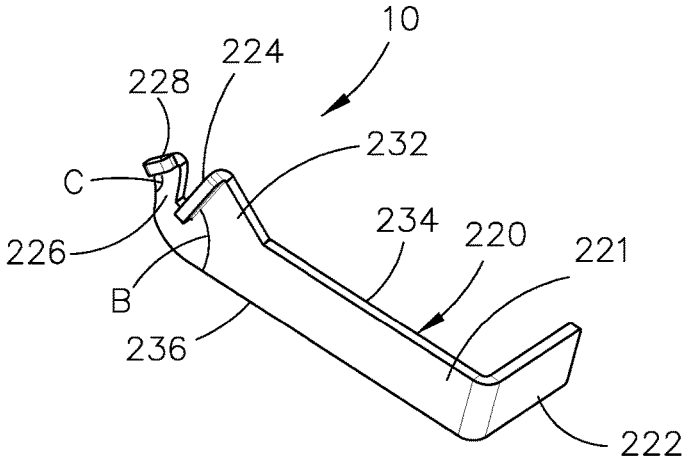
FIG. 3 is an isometric view of the present invention.
Figure 3A:
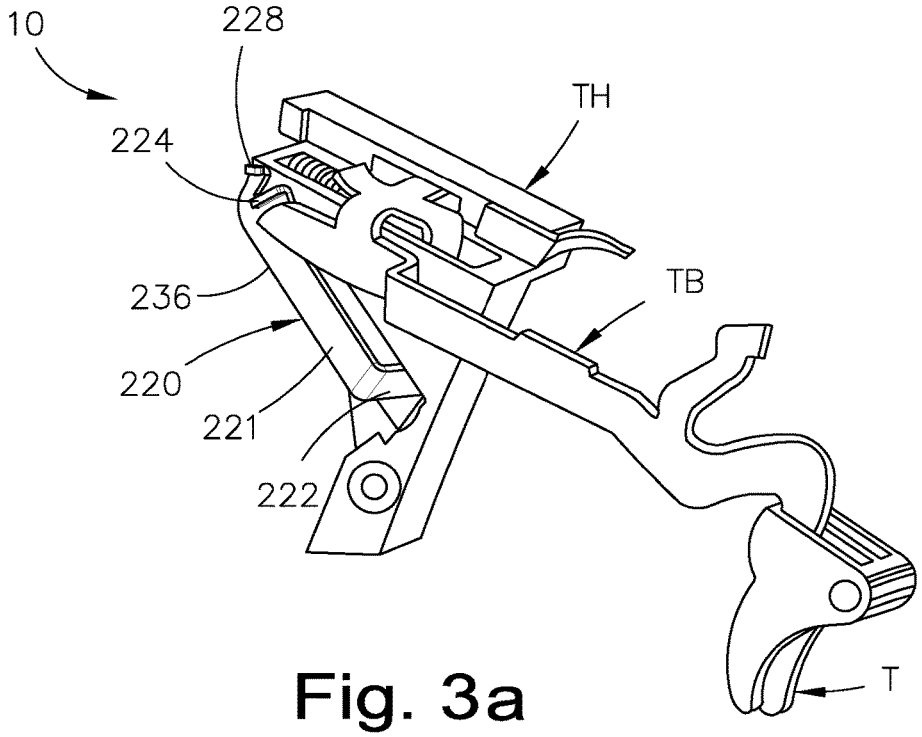
FIG. 3*a* is an isometric view of the present invention mounted onto a trigger bar and housing.

Seen in FIGS. 3 and 3*a* is the present invention, defined as firearm enhancing trigger connector 220. Firearm enhancing trigger connector 220 has torso 221 having first and second edges 234 and 236 respectively. Torso 221 has guide lip mount 232 extending from torso 221 beyond first edge 234 at a first predetermined angle. Guide lip mount 232 comprises guide lip 224 positioned at a second predetermined angle B approximately 65-75 degrees with respect to second edge 236. In a preferred embodiment, the second predetermined angle B is approximately 70 degrees. Guide lip 224 contains trigger bar TB of firearm F, seen in FIG. 4. Torso 221 further comprises first connector leg 226 extending from torso 221 towards first edge 234 at a third predetermined angle. First connector leg 226 has reset tab 228 at a fourth predetermined angle C approximately between 81 degrees and 91 degrees with respect to first connector leg 226. In a preferred embodiment, fourth predetermined angle C is approximately 86 degrees. Approximately opposite in direction from guide lip 224 and reset tab 228 is connector leg 222. Guide lip mount 232 extends from torso 221 beyond first edge 234 a first predetermined distance and first connector leg 226 extends from torso 221 beyond first edge 234 a second predetermined distance, wherein the first predetermined distance is greater than the second predetermined distance. First connector leg 226 extends from second edge 236 defining a corner as it extends from second edge 236. Reset tab 228 is positioned over guide lip 224, and guide lip 224 is shorter in length than reset tab 228, whereby a distance from reset tab 228 to connector leg 222 is longer than a distance from guide lip 224 to connector leg 222.

In addition, first connector leg 226 defines a fifth predetermined angle with respect to guide lip 224, wherein the fifth predetermined angle is less than 90 degrees.

Figure 4:
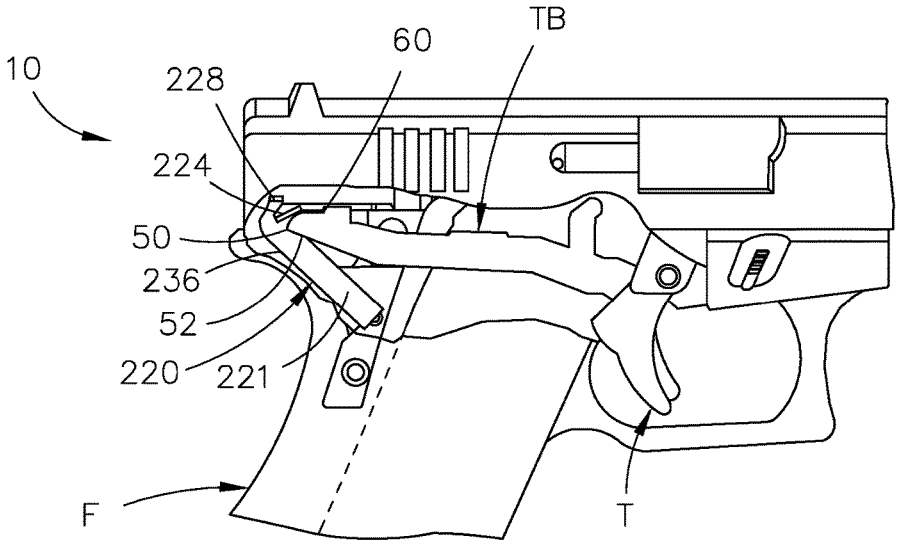
FIG. 4 is an elevation view of the present invention mounted onto the trigger bar and housing, before firing the firearm.

FIG. 3*a* illustrates trigger bar TB secured onto trigger housing TH. Guide lip 224 serves to contain trigger bar TB when biased against it. Connector leg 222 removably fits within firearm F, as seen in FIG. 4, to remain secured. Trigger bar TB nearly contacts or contacts guide lip 224 when firearm F is in a rest position.

The conventional placement of guide lip 224 and reset tab 228 is reversed from the prior art. Changing their placement creates the smoothest trigger pull possible. Thus, providing a mechanical advantage with present invention 10.

As seen in FIG. 4, firearm F is in the rest position. Once a user grasps firearm F, aims, and is ready to fire, the user exerts a force to overcome the force of trigger T. Trigger T is mechanically connected to trigger bar TB. In the rest position, trigger bar TB is biased against torso 221. It is noted that guide lip 224 is located at a predetermined positioned forward and elevated as compared to connector lip 24', seen in FIG. 1, and has a predetermined angle B to contain trigger bar TB when biased against it.

More specifically, guide lip 224 is positioned at the predetermined angle B, whereby end 50 of trigger bar TB nearly contacts, or contacts, guide lip 224 when firearm F is in the rest position, as illustrated, to eliminate undesired trigger pull obstruction and to minimize trigger pull effort when trigger T is pulled. In a preferred embodiment, nearly contacts are defined as a distance up to approximately 3 mm.

As trigger T is pulled, trigger bar TB slidably travels generally in a rearward and downward direction and guide lip 224 serves to guide end 50 with no obstruction. The no obstruction is achieved with the predetermined angle B for guide lip 224, saving the user from exerting a second force after exerting an initial force to pull trigger T. Thus, resulting in improved accuracy and precision when firing. Trigger bar TB remains biased against torso 221 at the point of firing.

Figure 4A:
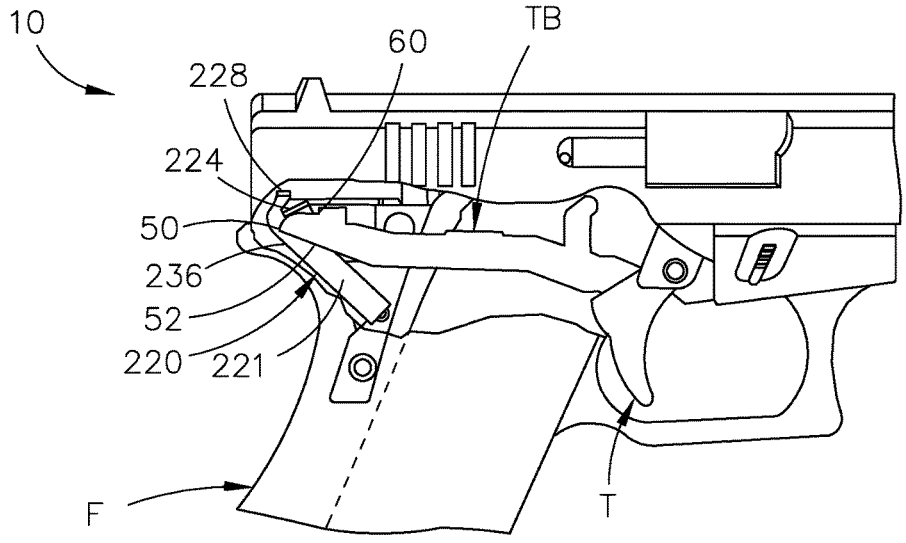
FIG. 4*a* is an elevation view of the present invention seen in FIG. 3, after firing the firearm.

As seen in FIG. 4*a*, after the point of firing, trigger bar TB continuous to travel generally in a rearward and downward direction. Trigger bar TB then slidably travels generally in a forward and upward direction until completing the operating cycle. With a shortened trigger travel distance, less time is required for the user to discharge firearm F. As a result, the user benefits from each subsequent discharge with less time required for firearm F to cycle back into the rest position, as in FIG. 4.

Figure 5:
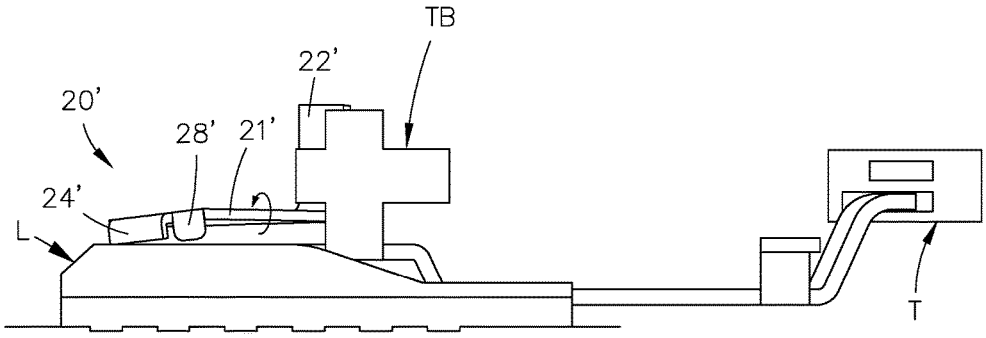
Fig. 5 PRIOR ART
FIG. 5 is a top view of the prior art trigger connector seen in FIG. 1, illustrating torsion forces while cycling.

As seen in FIG. 5, after the point of firing, trigger bar TB continues to travel generally in a rearward and downward direction. Connector lip 28' is cammed inwardly by lobe L until a spring force, not shown, causes trigger bar TB to shift. Edge 52, seen in FIG. 4A, of trigger bar TB slidably travels generally in a forward and upward direction. Lobe L defines a ramped surface that cams connector lip 28' while cycling until completing the operating cycle. However, due to its position, connector lip 28' also is an obstruction. This obstruction causes torsion forces upon prior art connector 20' while cycling. Thus, compromising the stability and durability of prior art connector 20'.

Figure 6:
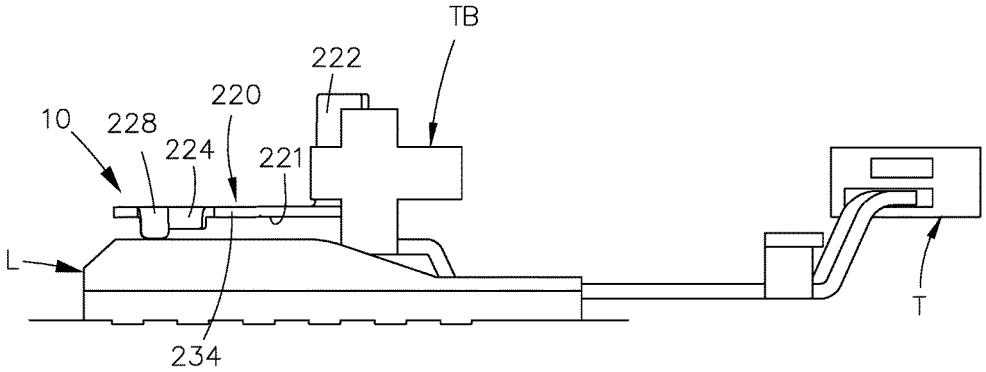
FIG. 6 is a top view of the present invention seen in FIG. 3, while cycling.

As seen in FIG. 6, after the point of firing, trigger bar TB continues to travel generally in a rearward and downward direction. Reset tab 228 is cammed inwardly by lobe L until a spring force, not shown, causes trigger bar TB to shift. Edge 52, seen in FIG. 4A, of trigger bar TB slidably travels generally in a forward and upward direction. Lobe L defines a ramped surface that cams reset tab 228 while cycling until completing the operating cycle with minimal obstruction. The minimal obstruction is achieved with the length and the fourth predetermined angle of reset tab 228, minimizing torsion forces upon firearm enhancing trigger connector 220 while cycling. Thus, resulting in improved stability and durability. The fourth predetermined angle is approximately 86 degrees.

Firearm enhancing trigger connector 220 is made out of a durable and light weight material as stainless steel, alloy metal, or other material having similar characteristics. In the preferred embodiment, firearm enhancing trigger connector 220 is manufactured as a single metallic piece and have a general consistent thickness throughout of approximately 0.10 mm to 2.00 mm, so as to cooperatively interact with the general trigger mechanism of semiautomatic firearms that have an enclosed striker assembly. Such a firearm may be "GLOCK", without limitation to this specific brand.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A firearm enhancing trigger connector, comprising a torso having first and second edges, said torso comprising a guide lip mount extending from said torso beyond said first edge at a first predetermined angle, said guide lip mount comprises a guide lip positioned at a second predetermined angle approximately 65-75 degrees with respect to said second edge, said guide lip mount extends from said torso beyond said first edge a first predetermined distance, said guide lip containing a trigger bar of a firearm, said torso further comprising a first connector leg extending from said torso towards said first edge at a third predetermined angle, said first connector leg extends from said torso beyond said first edge a second predetermined distance, whereby said first predetermined distance is greater than said second predetermined distance, said first connector leg having a reset tab at a fourth predetermined angle approximately between 81 degrees and 91 degrees with respect to said first connector leg, said torso further comprising a second connector leg that removably fits within a trigger housing of said firearm, said trigger bar nearly contacts or contacts said guide lip when said firearm is in a rest position.

2. The firearm enhancing trigger connector set forth in claim 1, further characterized in that said first connector leg extends from said second edge.

3. The firearm enhancing trigger connector set forth in claim 1, further characterized in that said reset tab is positioned over said guide lip.

4. The firearm enhancing trigger connector set forth in claim 1, further characterized in that said guide lip is shorter in length than said reset tab.

5. The firearm enhancing trigger connector set forth in claim 1, further characterized in that said guide lip contains said trigger bar of said firearm when biased against said guide lip.

6. The firearm enhancing trigger connector set forth in claim 1, further characterized in that said trigger bar is biased against said torso when said firearm is in said rest position.

7. The firearm enhancing trigger connector set forth in claim 1, further characterized in that said nearly contacts is a distance up to approximately 3 mm.

8. The firearm enhancing trigger connector set forth in claim 1, further characterized in that as a trigger is pulled, said trigger bar slidably travels generally in a rearward and downward direction and said guide lip serves to guide an end of said trigger bar with no obstruction.

9. The firearm enhancing trigger connector set forth in claim 8, further characterized in that said no obstruction is achieved with said second predetermined angle for said guide lip, saving a user from exerting a second force after exerting an initial force to pull said trigger.

10. The firearm enhancing trigger connector set forth in claim 1, further characterized in that after a point of firing, said trigger bar continues to travel generally in a rearward and downward direction.

11. The firearm enhancing trigger connector set forth in claim 1, further characterized in that a lobe cams said reset tab while cycling until completing an operating cycle with minimal obstruction.

12. The firearm enhancing trigger connector set forth in claim 11, further characterized in that said minimal obstruction is achieved with said fourth predetermined angle of said reset tab, minimizing torsion forces while said cycling occurs.

13. The firearm enhancing trigger connector set forth in claim 1, further characterized in that said second connector leg is approximately opposite in direction from said guide lip.

14. The firearm enhancing trigger connector set forth in claim 1, further characterized in that said second connector leg is approximately opposite in direction from said reset tab.

15. The firearm enhancing trigger connector set forth in claim 1, further characterized in that said second connector leg is approximately opposite in direction from said guide lip and said reset tab.

16. The firearm enhancing trigger connector set forth in claim 1, further characterized in that said second predetermined angle is approximately 70 degrees.

17. The firearm enhancing trigger connector set forth in claim 1, further characterized in that said fourth predetermined angle is approximately 86 degrees.

* * * * *